US007966981B2

(12) United States Patent
Park et al.

(10) Patent No.: US 7,966,981 B2
(45) Date of Patent: Jun. 28, 2011

(54) VARIABLE VALVE LIFT APPARATUS

(75) Inventors: Sung Bong Park, Seoul (KR); Bosung Shin, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 405 days.

(21) Appl. No.: 12/324,534

(22) Filed: Nov. 26, 2008

(65) Prior Publication Data

US 2009/0151678 A1 Jun. 18, 2009

(30) Foreign Application Priority Data

Dec. 14, 2007 (KR) ..... 10-2007-0131659

(51) Int. Cl.
*F01L 1/34* (2006.01)

(52) U.S. Cl. ..... 123/90.16; 123/90.15

(58) Field of Classification Search ..... 123/90.15, 123/90.16; 74/569
See application file for complete search history.

(56) References Cited

U.S. PATENT DOCUMENTS 7,213,551 B2 * 5/2007 Asada et al. ..... 123/90.16

* cited by examiner

*Primary Examiner* — Zelalem Eshete
(74) *Attorney, Agent, or Firm* — Morgan, Lewis & Bockius LLP

(57) ABSTRACT

A variable valve lift apparatus may include a camshaft in which a cam is formed co-axially thereon; a variable shaft in which a groove is formed in an exterior circumference at a portion thereof, wherein the variable shaft is disposed in parallel with the camshaft; a variable guide, one end surface of which contacts the cam and the other end surface of which is inserted inside the groove of the variable shaft; a lever through which the variable shaft is rotatably inserted and on which the variable guide is slidably mounted; and a valve that is selectively lifted by the lever, wherein the variable guide selectively is inserted into the groove of the variable shaft to vary lift amount of the valve in accordance with rotation of the variable shaft.

19 Claims, 6 Drawing Sheets

VARIABLE VALVE LIFT APPARATUS

CROSS-REFERENCE TO RELATED APPLICATION

The present application claims priority to Korean Patent Application Number 10-2007-0131659 filed Dec. 14, 2007, the entire contents of which application is incorporated herein for all purposes by this reference.

BACKGROUND OF THE INVENTION

1. Field of the Invention

The present invention relates to a variable valve lift apparatus, and more particularly to a variable valve lift apparatus for varying the lift amount of a valve.

2. Description of Related Art

A general cam that is mounted on an engine cannot vary the lift amount of a valve and cannot optimize fuel consumption and power.

Recently, experiments that change the lift amount, the opening timing, and the opening period of intake/exhaust valves have been carried at a good pace in order to improve output and efficiency of an engine.

Among them, there is a continuously variable valve lift apparatus (CVVL).

The continuously variable valve lift apparatus varies the lift amount of the intake/exhaust valves in accordance with driving conditions of the engine.

Accordingly, intake flux can be maximized in high speed/load conditions of driving in which high power is demanded, and simultaneously the intake flux can be minimized in low speed/load conditions of driving in which it is necessary to reduce exhaust gas and fuel consumption.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a variable valve lift apparatus having advantages of adequately varying the lift amount.

In an aspect of the present invention, a variable valve lift apparatus may include a camshaft in which a cam is formed co-axially thereon, a variable shaft in which a groove is formed in an exterior circumference at a portion thereof, wherein the variable shaft is disposed in parallel with the camshaft, a variable guide, one end surface of which contacts the cam and the other end surface of which is inserted inside the groove of the variable shaft, a lever through which the variable shaft is rotatably inserted and on which the variable guide is slidably mounted, and/or a valve that is selectively lifted by the lever, wherein the variable guide selectively is inserted into the groove of the variable shaft to vary lift amount of the valve in accordance with rotation of the variable shaft.

A spring may elastically support the lever and the camshaft.

The variable valve lift may further include a supporting member that is rotatably mounted on the camshaft, wherein the spring couples the supporting member and the lever. The camshaft may be inserted into the supporting member.

The variable valve lift apparatus may further include a swing arm of which one side is pivotally supported by a supporting portion and the other side is moved by the lever, wherein the valve is moved by the swing arm.

A lift control member may be formed at the groove and is configured to extend outwards from rotation center of the variable shaft in a rotating direction of the variable shaft. The lift control member may have a spiral structure configured to be continuously shorter or longer according to the rotation of the variable shaft so that the lift amount of the valve can be continuously varied.

In another aspect of the present invention, a variable valve lift apparatus may include a camshaft including a cam co-axially formed therein, a variable shaft disposed in parallel with the camshaft and including a first groove formed at an exterior circumference thereof and a lift control member formed in the first groove, a lever including an output cam and a second groove, wherein the variable shaft is rotatably inserted through the lever, a variable guide including a contact profile and a lift profile, wherein the contact profile contacts the cam and one end portion of the variable guide is slidably inserted into the second groove of the lever and mounted to the first groove of the variable shaft through the second groove, and/or a valve that is selectively lifted by the output cam of the lever and thus lift amount of the valve is varied in accordance with rotation of the variable shaft.

An elastic member may support the lever and the camshaft. The elastic member may be a spring.

The variable valve lift apparatus may further include a supporting member that is rotatably mounted on the camshaft, wherein the elastic member couples the supporting member and the lever. The camshaft may be rotatably inserted into the supporting member.

The variable valve lift apparatus may include a swing arm of which one side is pivotally supported by a supporting portion and the other side is moved by the lever, wherein the valve is moved by the swing arm. The swing arm may include a protruding portion slidably contacting the output cam of the lever.

The lift control member may be formed at the first groove and is configured to extend outwards from rotation center of the variable shaft in a rotating direction of the variable shaft. The lift control member may have a spiral structure configured to be continuously shorter or longer according to the rotation of the variable shaft so that the lift amount of the valve can be continuously varied.

The lift profile may have a semi-circular shape.

The contact profile may have a convex shape facing the cam wherein upper portion of the contact profile is narrower than lower portion thereof.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
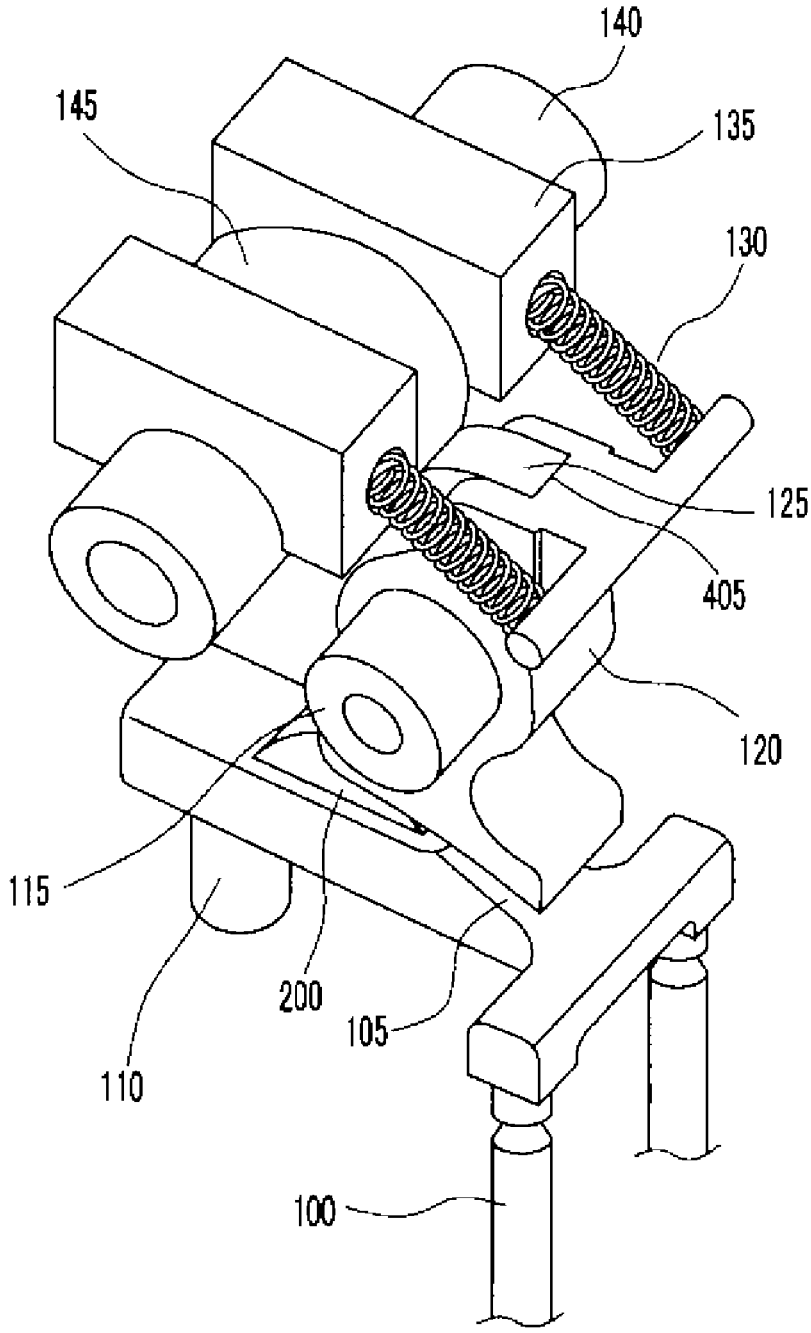
FIG. 1 is a partial perspective view of an exemplary variable valve lift apparatus according to the present invention.

FIG. 1 is a partial perspective view of a variable valve lift apparatus according to various embodiments of the present invention.

Referring to FIG. 1, a variable valve lift apparatus includes a valve 100, a swing arm 105, a supporting portion 110, a variable shaft 115, a lever 120, a variable guide 125, a spring 130, a supporting member 135, and a camshaft 140.

A cam 145 is formed on the camshaft 140, and a protruding portion 200 is formed in an upper portion of the swing arm 105.

The camshaft 140 is configured to penetrate the supporting member 135, and the spring 130 is mounted between the supporting member 135 and the lever 120.

One end portion of the spring 130 is connected to the supporting member 135 and the other end portion of the spring 130 is connected to the lever 120. The spring 130 draws the lever 120 in a direction of the camshaft 140.

The variable guide 125 is mounted to the lever 120 and the variable shaft 115 is rotatably coupled to the lever 120.

Accordingly, the cam 145 and the variable guide 125 contact each other by the spring 130. In particular, the variable guide 125 includes a contact profile 127 and thus the cam 145 slidably contact the lift profile 127 of the variable guide 125 by the spring 130.

The camshaft 140 and the variable shaft 115 are configured to be parallel to each other.

Figure 4:
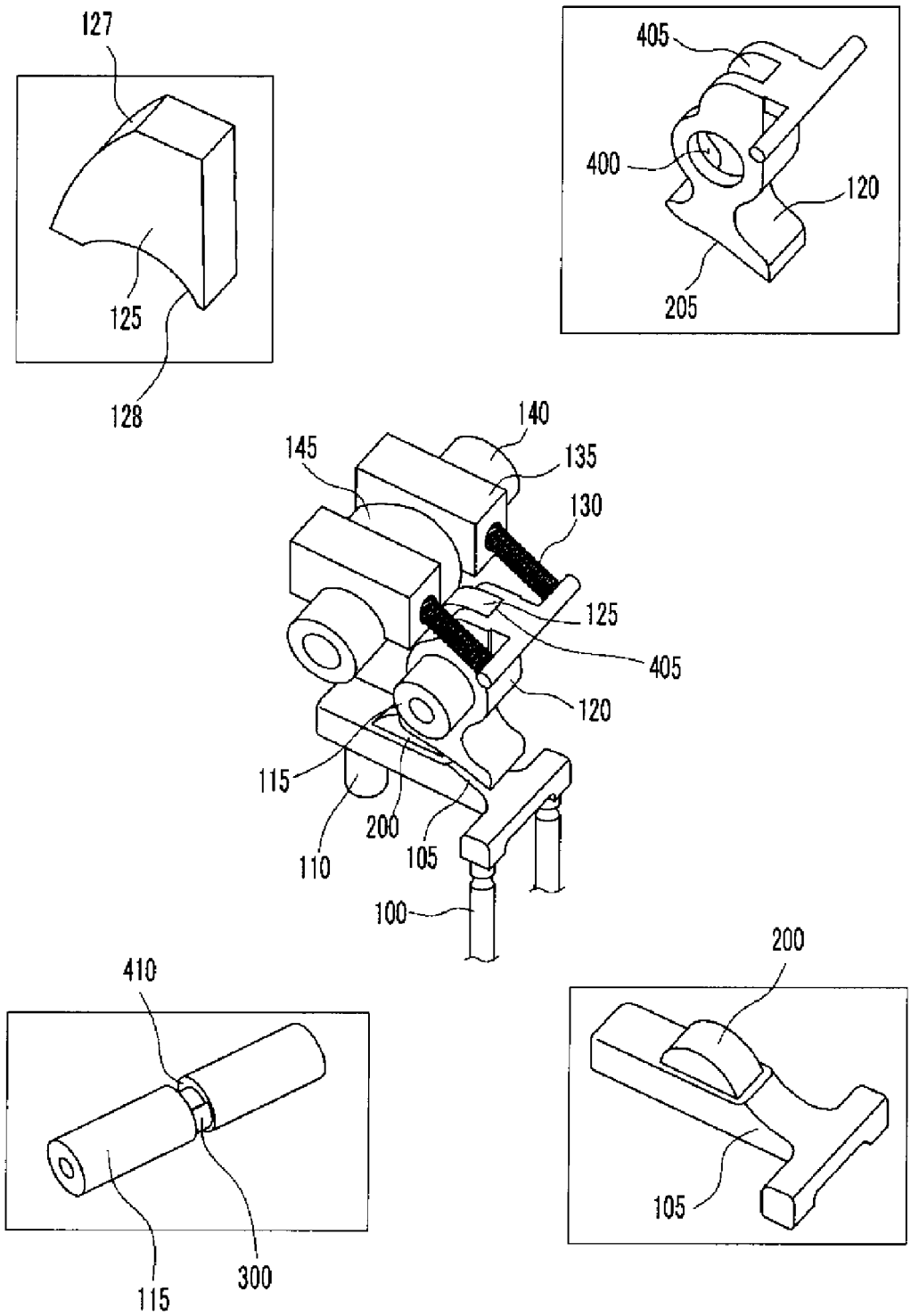
FIG. 4 is an exploded perspective view of an exemplary variable valve lift apparatus according to the present invention.

The variable shaft 115 penetrates a portion of the lever 120 to form a hole (400 FIG. 4). Also, the variable guide 125 is inserted into a groove (405, FIG. 4) that is formed in one side of the lever 120 that faces the cam 145.

The position of the variable guide 125 varies in accordance with the rotation of the variable shaft 115 so that the lift amount of the valve 100 varies according to the rotation of the variable shaft 115 as explained in detail hereinafter.

Figure 2A:
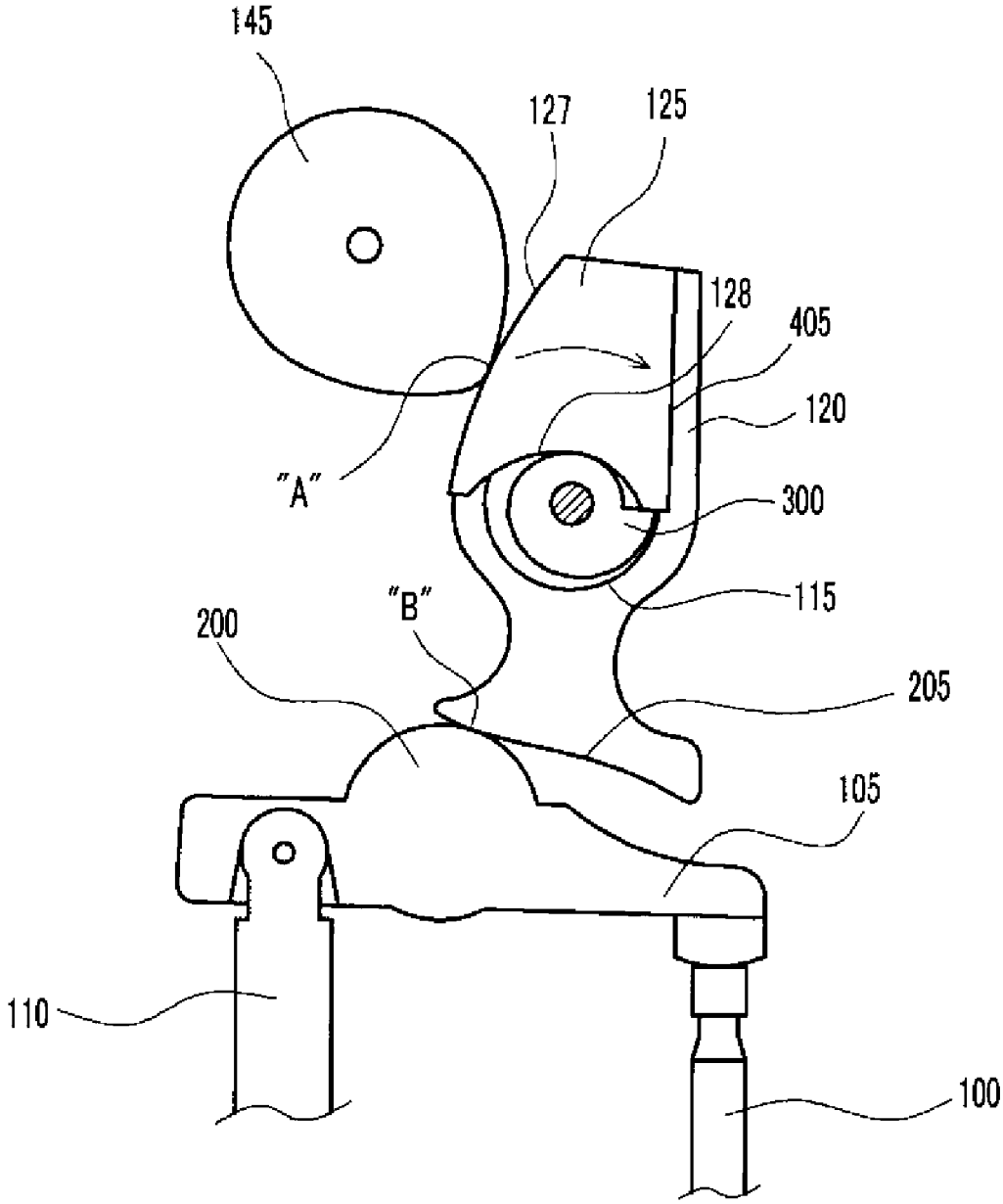
FIG. 2A is a side view of an exemplary first condition according to the present invention.
Figure 2B:
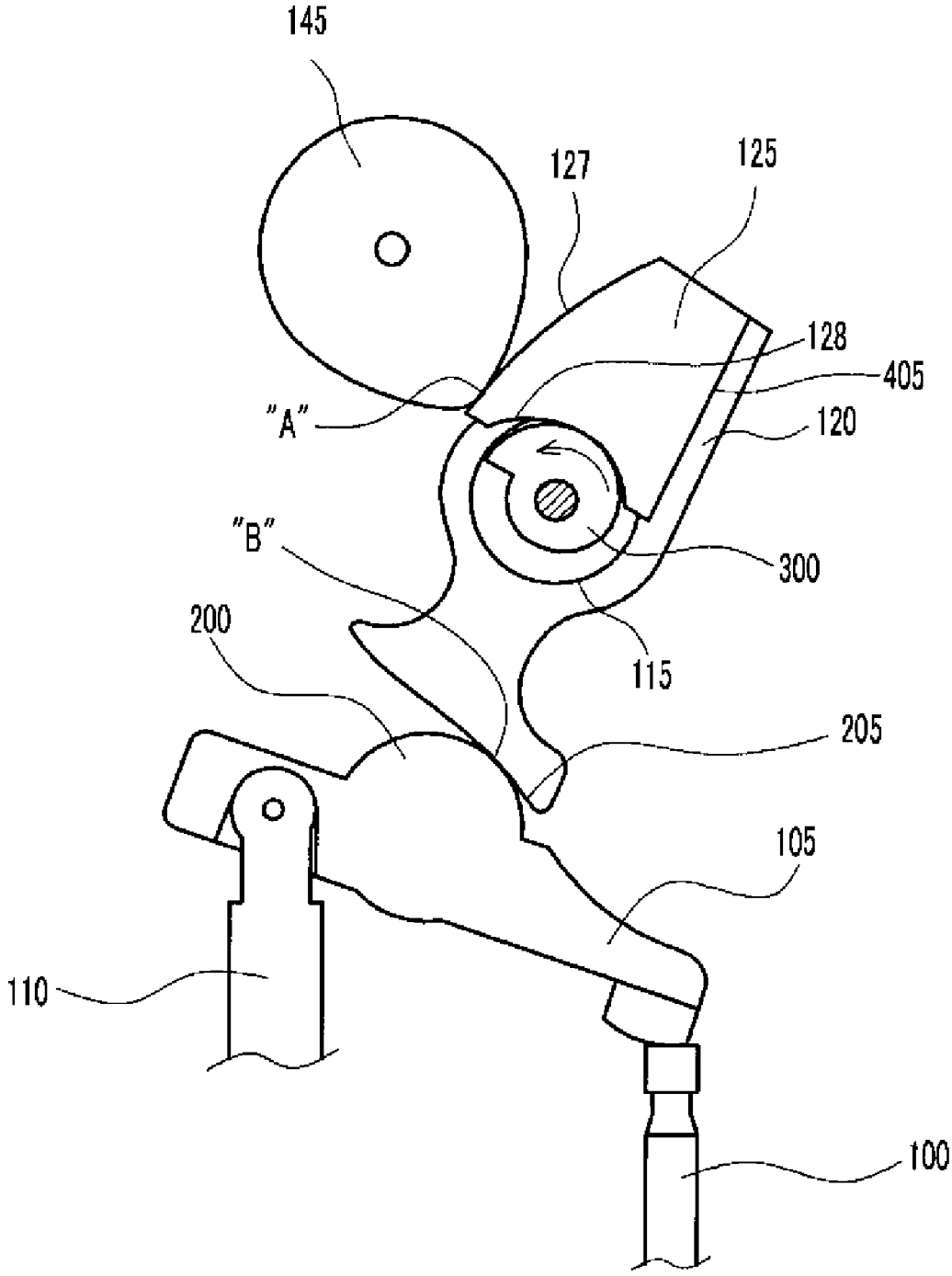
FIG. 2B is a side view of an exemplary second condition according to the present invention.

FIG. 2A is a side view of a low lift mode according to various embodiments of the present invention, and FIG. 2B is a side view of a high lift mode according to various embodiments of the present invention.

Referring to FIG. 2A and FIG. 2B, one portion of the variable guide 125 may be inserted into the lever 120 in a direction of the rotation center of the variable shaft 115 in FIG. 2A. The variable guide 125 includes a lift profile 128 at the lower portion thereof and the lift profile 128 of the variable guide 125 is rotatably supported by the variable shaft 115.

Meanwhile, the variable guide 125 may move from the rotation center of the variable shaft 115 in a radial direction along the groove 405 in FIG. 2B.

In this configuration, the relative distance between a contact point A of the cam 145 and the variable guide 125 and a contact point B of the swing arm 105 and the output cam 205 in FIG. 2A is smaller than that in FIG. 2A.

The lift amount of the valve 100 is small in FIG. 2A so as to accomplish the low lift mode and the lift amount of the valve 100 is large in FIG. 2B so as to accomplish the high lift mode.

The movement characteristics of the swing arm 105 vary in various embodiments by the rotation of the variable shaft 115 that modify the positions of contact points A and B as explained above.

According to position of the contact point A of the variable guide 125 and the cam 145, the lever 120 may rotate in the clockwise or anti-clockwise direction.

For instance, as the variable guide 125 moves upwards in a radial direction from the rotation center of the variable shaft 115 according to rotation of the variable shaft 115, the cam 145 pushes the lever 120 in the clockwise direction so that the relative distance between the contact point A and the contact point B is increased so as to achieve the high lift mode.

In contrast, as the variable guide 125 moves downwards in a radial direction according to rotation of the variable shaft 115, the spring 130 rotates the lever 120 towards the cam 145 in the anti-clockwise direction so that the relative distance between the contact point A and the contact point B is reduced so as to achieve the low lift mode.

The contact profile 127 of the variable guide 125 that contacts the cam 145 has a convex shape toward the cam 145.

In FIG. 2A, an output cam 205 is formed at a lower portion of the lever 120 and one surface of the output cam 205 pushes the protruding portion 200 of the swing arm 105. In a like manner, the one surface of the output cam 205 pushes the protruding portion 200 of the swing arm 105 in FIG. 2B.

While one side of the swing arm 105 is pivotally fixed by the supporting portion 110, the other side pushes and moves the valve 100 according to the movement of the lever 120.

Figure 3A:
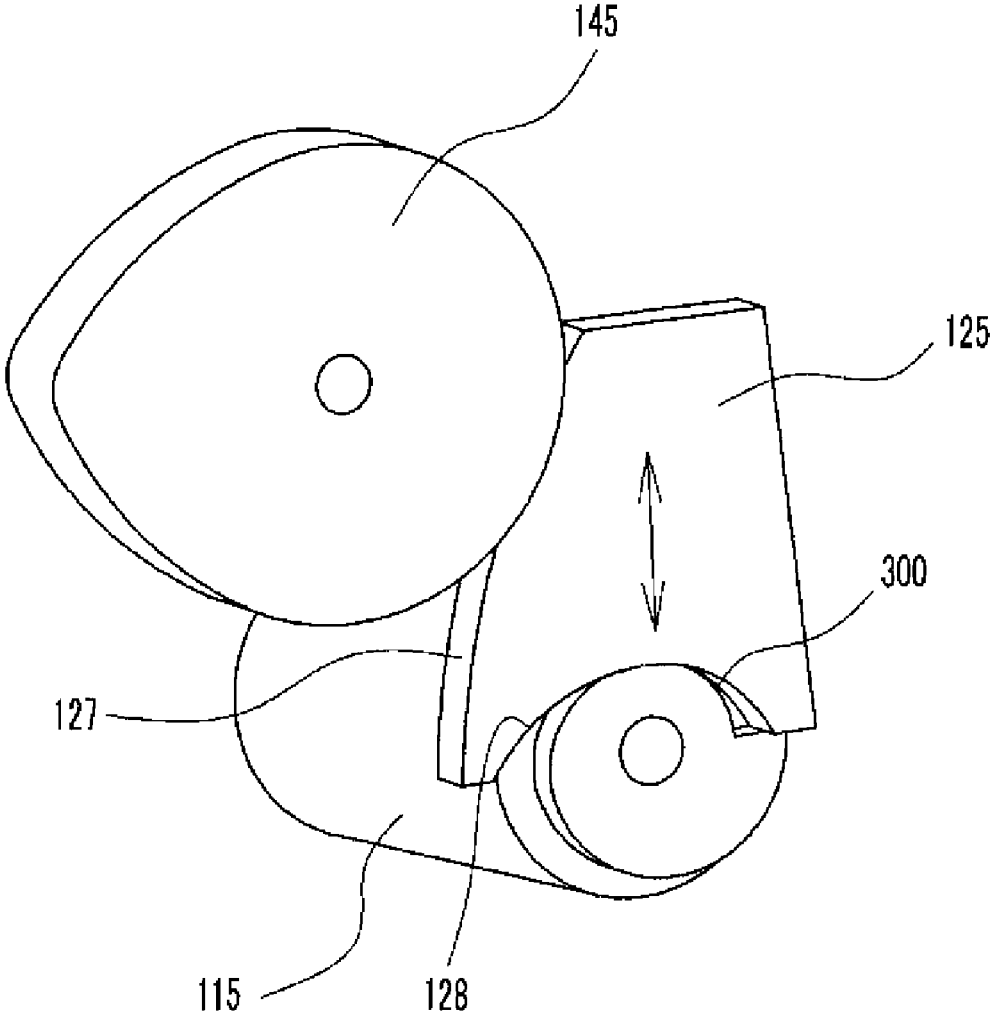
FIG. 3A is a partial detailed view of FIG. 2B.
Figure 3B:
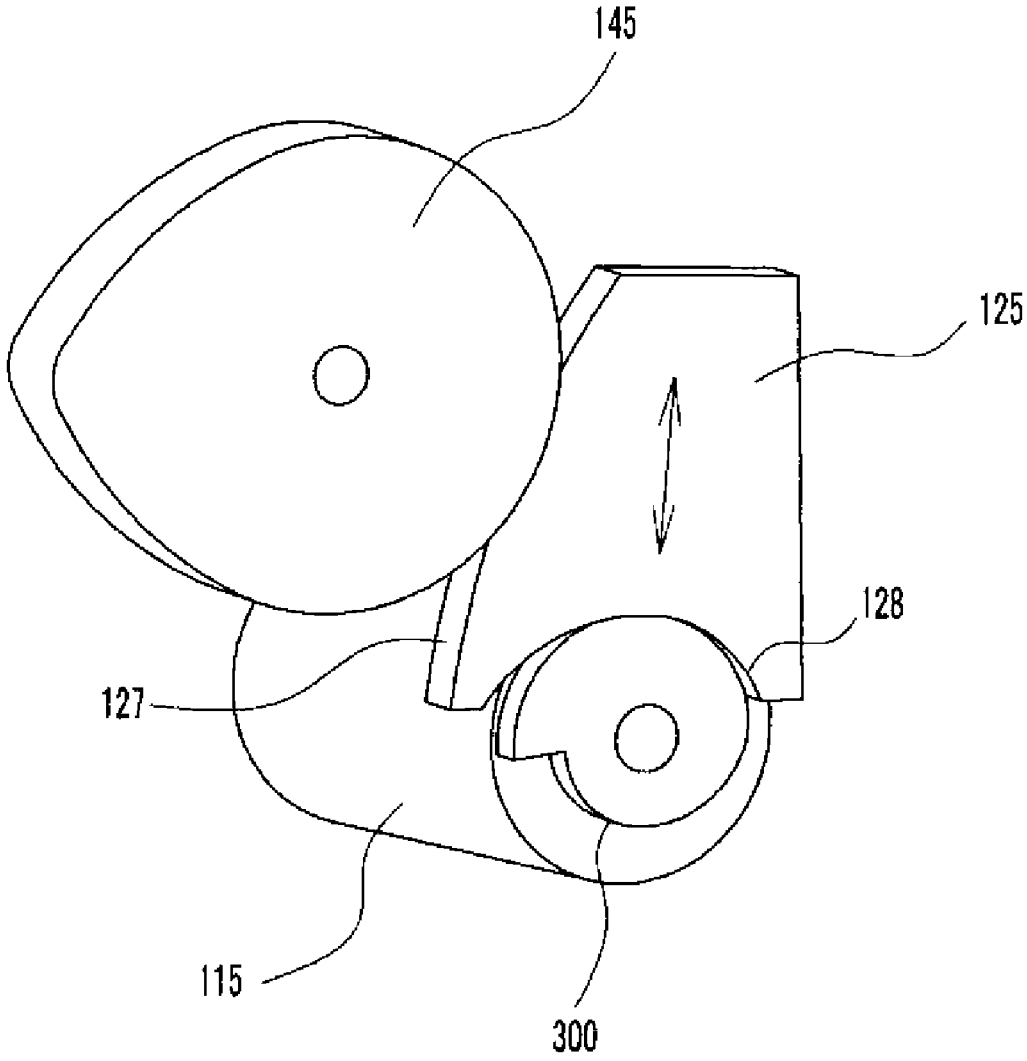
FIG. 3B is a partial detailed view of FIG. 2A.

FIG. 3A is a partial detailed view of FIG. 2B, and FIG. 3B is a partial detailed view of FIG. 2A.

As shown in FIG. 3A and FIG. 3B, a groove (410, FIG. 4) is formed in the variable shaft 115. The groove (410, FIG. 4) is formed in a rotating direction of the variable shaft 115, and the lift control member 300 formed in the groove (410, FIG. 4) is configured to extend outwards from the rotation center of the variable shaft 115 in a rotating direction of the variable shaft 115. Accordingly, the depth of the lift control member 300 of the groove (410, FIG. 4) becomes continuously greater in a rotating direction.

Accordingly, the variable guide 125 contacting the lift control member 300 continuously moves in a radial direction from the rotation center of the variable shaft 115 according to rotation of the variable shaft 115.

FIG. 4 is an exploded perspective view of a variable valve lift apparatus according to various embodiments of the present invention.

Referring to FIG. 4, a hole 400 is formed in both sides of the lever 120, and the variable shaft 115 is slidably inserted through the hole 400.

A groove 405 that communicates with the hole 400 is formed in a frontward direction of the lever 120, and the variable guide 125 is inserted in the groove 405.

A groove 410 is formed in one side of the exterior surface of the variable shaft 115 and the variable guide 125 is mounted in the groove 410.

The surface of the variable guide 125 that contacts the lift control member (300, FIG. 3B) of the groove 410 includes the lift profile 128 having a curved line shape in the groove 410 in the variable guide 125.

For convenience in explanation and accurate definition in the appended claims, the terms "high", "low", "frontward", "exterior", and "inner" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus, comprising:

a camshaft in which a cam is formed co-axially thereon;

a variable shaft in which a groove is formed in an exterior circumference at a portion thereof, wherein the variable shaft is disposed in parallel with the camshaft;

a variable guide, one end surface of which contacts the cam and the other end surface of which is inserted inside the groove of the variable shaft;

a lever through which the variable shaft is rotatably inserted and on which the variable guide is slidably mounted; and a valve that is selectively lifted by the lever, wherein the variable guide selectively is inserted into the groove of the variable shaft to vary lift amount of the valve in accordance with rotation of the variable shaft.

2. The variable valve lift apparatus of claim 1, wherein a spring elastically supports the lever and the camshaft.

3. The variable valve lift apparatus of claim 2, further comprising a supporting member that is rotatably mounted on the camshaft, wherein the spring couples the supporting member and the lever.

4. The variable valve lift apparatus of claim 3, wherein the camshaft is inserted into the supporting member.

5. The variable valve lift apparatus of claim 1, further comprising a swing arm of which one side is pivotally supported by a supporting portion and the other side is moved by the lever, wherein the valve is moved by the swing arm.

6. The variable valve lift apparatus of claim 1, wherein a lift control member is formed at the groove and is configured to extend outwards from rotation center of the variable shaft in a rotating direction of the variable shaft.

7. The variable valve lift apparatus of claim 6, wherein the lift control member has a spiral structure configured to be continuously shorter or longer according to the rotation of the variable shaft so that the lift amount of the valve can be continuously varied.

8. A variable valve lift apparatus, comprising:

a camshaft including a cam co-axially formed therein;

a variable shaft disposed in parallel with the camshaft and including a first groove formed at an exterior circumference thereof and a lift control member formed in the first groove;

a lever including an output cam and a second groove, wherein the variable shaft is rotatably inserted through the lever;

a variable guide including a contact profile and a lift profile, wherein the contact profile contacts the cam and one end portion of the variable guide is slidably inserted into the second groove of the lever and mounted to the first groove of the variable shaft through the second groove; and a valve that is selectively lifted by the output cam of the lever and thus lift amount of the valve is varied in accordance with rotation of the variable shaft.

9. The variable valve lift apparatus of claim 8, wherein an elastic member supports the lever and the camshaft.

10. The variable valve lift apparatus of claim 9, the elastic member is a spring.

11. The variable valve lift apparatus of claim 9, further comprising a supporting member that is rotatably mounted on the camshaft, wherein the elastic member couples the supporting member and the lever.

12. The variable valve lift apparatus of claim 11, wherein the camshaft is rotatably inserted into the supporting member.

13. The variable valve lift apparatus of claim 8, further comprising a swing arm of which one side is pivotally supported by a supporting portion and the other side is moved by the lever, wherein the valve is moved by the swing arm.

14. The variable valve lift apparatus of claim 13, wherein the swing arm comprises a protruding portion slidably contacting the output cam of the lever.

15. The variable valve lift apparatus of claim 8, wherein the lift control member is formed at the first groove and is configured to extend outwards from rotation center of the variable shaft in a rotating direction of the variable shaft.

16. The variable valve lift apparatus of claim 15, wherein the lift control member has a spiral structure configured to be continuously shorter or longer according to the rotation of the variable shaft so that the lift amount of the valve can be continuously varied.

17. The variable valve lift apparatus of claim 8, wherein the lift profile has a semi-circular shape.

18. The variable valve lift apparatus of claim 8, wherein the contact profile has a convex shape facing the cam wherein upper portion of the contact profile is narrower than lower portion thereof.

19. An engine comprising the variable valve lift apparatus of claim 8.

* * * * *